United States Patent [19]

Piatt

[11] Patent Number: 4,940,437

[45] Date of Patent: Jul. 10, 1990

[54] SWIM FIN WITH HARNESS

[76] Inventor: John A. Piatt, 226 Getchell St., Santa Cruz, Calif. 95060

[21] Appl. No.: 301,442

[22] Filed: Jan. 25, 1989

Related U.S. Application Data

[63] Continuation-in-part of Ser. No. 202,109, Jun. 3, 1988, Pat. No. 4,889,510.

[51] Int. Cl.[5] ..... A63C 31/10

[52] U.S. Cl. ..... 441/62; 441/63; 441/64; 441/61

[58] Field of Search ..... 441/55, 61–65, 441/75; 36/8.1, 11.5, 113, 115

[56] References Cited

U.S. PATENT DOCUMENTS

| | | | |
|---|---|---|---|
| 335,015 | 1/1886 | Corbett | 441/61 |
| 641,180 | 1/1900 | Bartholomew | 441/61 |
| 802,306 | 10/1905 | McKittrick | 441/61 |
| 1,626,175 | 4/1927 | Zimmer | 441/64 |
| 1,745,280 | 1/1930 | Snapp | 441/61 |
| 2,017,463 | 10/1935 | Komadina | 441/62 |
| 2,172,938 | 9/1939 | Kahn | 441/63 |
| 3,952,351 | 4/1976 | Gisbert | 441/64 |
| 4,250,584 | 2/1981 | Korai | 441/61 |
| 4,599,071 | 7/1986 | Juang | 441/64 |

*Primary Examiner*—Joseph F. Peters, Jr.
*Assistant Examiner*—C. T. Bartz
*Attorney, Agent, or Firm*—Robert Charles Hill

[57] ABSTRACT

A swim fin includes harness for attachment to a wearer's foot, the harness including an adjustable strap secured to the fin on opposite sides of a forward portion of the wearer's foot, the adjustable strap forming an X configuration passing over the wearer's instep and around the wearer's heel. Liner straps are arranged between forward portions of the adjustable strap and the wearer's foot while lateral straps are anchored to rearward portions of the fine and secured to opposite side portions of the adjustable strap. The fin has a generally flat configuration with one or more flanges extended beneath the wearer's foot and along forward portions of the fin for controlling the amount of bending or flexing experienced by the fin.

11 Claims, 2 Drawing Sheets

SWIM FIN WITH HARNESS

This is a continuation-in-part of application Ser. No. 07/202,109 filed June 3, 1988 by John A. Piatt and entitled "HARNESS FOR SWIM FINS" which issued Dec. 26, 1989 as U.S. Pat. No. 4,889,510. This case is referred to below as the "parent".

FIELD OF THE INVENTION

The present invention relates to swim fins with harness for securing the swim fin beneath a wearer's foot.

BACKGROUND OF THE INVENTION

Two types of harness for securing swim fins have been provided in the prior art. For example, swim fins are often formed with compartments enclosing the entire foot or only the toes and instep of the wearer's foot with an adjustable strap being provided around the heel to accommodate feet of different size. Such configurations are relatively expensive and do not provide the comfort or flexibility for varying foot sizes.

Harness or strap configurations have not been made available in designs for swim fins, except in the parent case noted above, but have been used for footwear such as sandals.

A typical footwear strap configuration of the type referred to immediately above was disclosed, for example, in U.S. Pat. No. 4,584,782 issued Apr. 29, 1986 to Thatcher. The strap arrangement of that patent is illustrative of the relatively complex configuration available in the prior art to provide for adjustment to the wearer's foot.

Accordingly, there has been found to remain a need for a harness or strap configuration of relatively simple design while providing adjustment to adapt the harness to varying foot sizes and also to provide a simple means for more securely fastening swim fins to a wearer's foot.

SUMMARY OF THE INVENTION

It is therefore an object of the invention to provide an improved swim fin with harness for securing the fin to a wearer's foot, the harness including a strap passing behind the wearer's heel, along both sides of the foot and over the instep in an X configuration for attachment to anchor points on the fin on opposite sides of a forward portion of the wearer's foot.

Preferably, lateral strap portions are secured to rear anchor points on the fin and to opposite side portions of the adjustable strap, for example, by respective slide means.

Even more preferably, the adjustable strap is formed by a single or unitary strap passing through slots at the forward anchor points of the fin and under the fin between the forward anchor points.

It is a further object of the invention to provide such a swim fin with harness further including liner straps arranged in slideable relation on respective portions of the adjustable strap passing over the instep portion of the wearer's foot for arrangement between the adjustable strap portions and the foot.

It is a further related object of the invention to provide a swim fin assembly including a swim fin formed with a generally flat configuration beneath the wearer's foot and an outwardly tapered portion extending forwardly of the wearer's foot whereby the fin is capable of bending or flexing beneath the wearer's foot rather than only forward of the foot in order to further facilitate effectiveness of the swim fin, and strap means secured to forward and rearward anchor points on the fin for passing over and around the wearer's foot to secure the swim fin thereupon without impeding movement of the wearer's toes.

Preferably, flange means are formed on the swim fin beneath and along the length of the wearer's foot and forwardly thereof for controlling the amount of bending or flexing experienced by the fin.

Additional objects and advantages of the invention are made apparent in the following description having reference to the accompanying drawings.

DESCRIPTION OF THE PREFERRED EMBODIMENT

A swim fin is illustrated in the Figures with harness for securing the fin to a wearer's foot, the swim fin being generally indicated at 10 and the harness being generally indicated at 12. Referring particularly to FIG. 2, a rearward portion 14 of the swim fin 10 is adapted or configured to fit beneath the wearer's foot. That portion 14 could be configured, for example, by means of indentations or the like (not shown) in order to better adapt the swim fin to the wearer's foot. It is also noted that the swim fin is generally foreshortened in FIGS. 1 and 2 in order to better illustrate construction and arrangement of the harness. The overall configuration of the swim fin 10 is better illustrated in FIG. 4A where its full length is shown.

In any event, the harness 12 is preferably positioned upon the swim fin 10 in order to secure the wearer's foot directly above the rearward portion 14. Referring again particularly to FIG. 2, the wearer's foot is indicated in phantom at 16, positioned upon the rearward portion 14 of the swim fin and secured by the harness 12.

Figure 1:
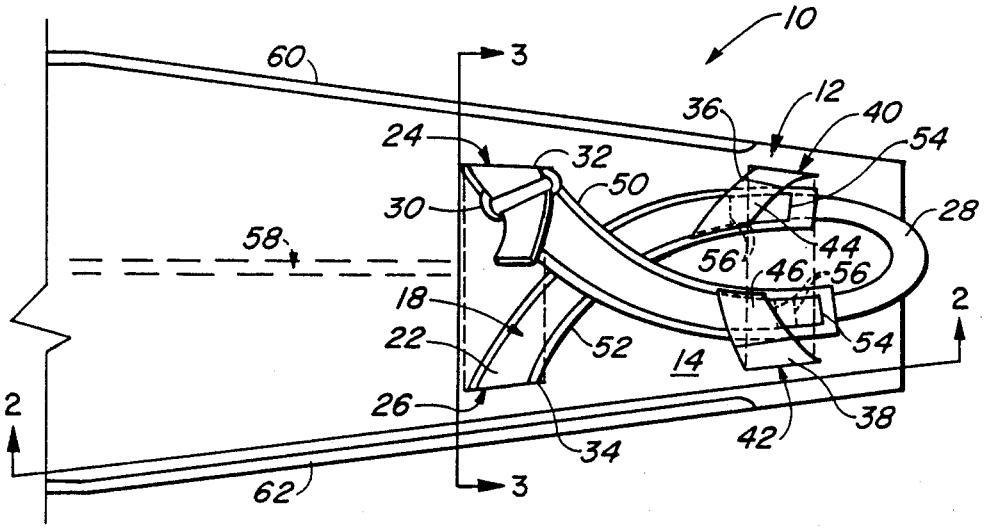
FIG. 1 is a top view of a swim fin with harness constructed according to the present invention for securing the swim fin to a wearer's foot.
Figure 2:
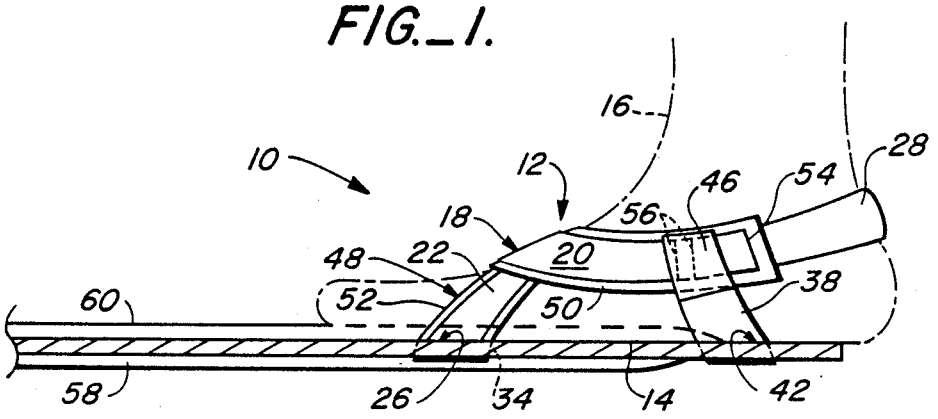
FIG. 2 is a view taken along section line II—II of FIG. 1 with the wearer's foot being illustrated in phantom to better demonstrate the purpose and configuration of the harness.
Figure 3:
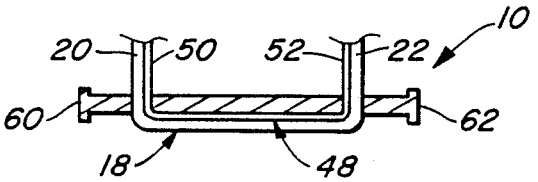
FIG. 3 is a view taken along section line III—III of FIG. 1.

Referring to FIGS. 1–3 in combination, the harness 12 comprises a single or unitary strap 18 including strap portions 20 and 22 extending from front anchor points 24 and 26 arranged on opposite sides of a forward portion of the wearer's foot.

The strap portions 20 and 22 form an X configuration passing over an instep portion of the wearer's foot. An extension 28 of the strap portion 22 passes around the wearer's heel and is secured to the other strap portion 20 by an adjustable buckle 30 preferably arranged over the wearer's instep as illustrated in FIG. 1. However, the buckle could be arranged in a similar position as illustrated in the parent case referred to above.

As may be best seen in FIG. 3, slots 32 and 34 are formed respectively at the forward anchor points 24 and 26. The single strap 18 passes through the slots 32 and 34 and beneath the fin between the slots.

Lateral strap portions 36 and 38 extend from rear anchor points 40 and 42 on opposite sides of the wearer's foot. Loops 44 and 46 are formed on the ends of the lateral strap portions 36 and 38 for receiving the side portions 20 and 22 of the single strap 18 as illustrated in FIGS. 1 and 2. The lateral strap portions 36 and 38 are also preferably formed as a single unitary strap with the rear anchor points 40 and 42 being slotted and the single unitary strap 36, 38 passing through the slotted anchor points and beneath the swim fin in the same manner as the adjustable strap 18.

To further facilitate adjustment of the harness 12 and make it more readily adaptable to fit feet of different size, a liner strap 48 is arranged adjacent a forward portion of the single strap 18 including the strap portions 20 and 22. As illustrated in FIGS. 1 and 3, the liner strap 48 also passes through the slots 32 and 34 and beneath the swim fin. Portions 50 and 52 of the liner strap 48 are arranged between the adjustable strap portions 20 and 22 and the wearer's foot, the liner portion 50 extending under the buckle 30 and a portion of the strap extension 28. The strap portions 50 and 52 are also formed with at least one slot 54 for receiving the respective adjustable strap portion 20 or 22 adjacent and preferably behind the loops 44 and 46. The liner strap 48 is formed from a material selected for cushioning the wearer's foot from forces of the harness, particularly when the strap portions 20 and 22 are being adjusted by the buckle 30.

Even more preferably, additional slots 56 are formed in each of the liner strap portions 50 and 52 to better adapt the harness for a variety of foot sizes. In this regard, it is important that the liner strap portions 50 and 52 be arranged smoothly between the adjustable strap portions 20, 22 and the wearer's foot to ensure comfort. Accordingly, for feet of different size, the strap portions 20 and 22 may be arranged in any one of the slots 54 or 56 to accomplish that purpose.

A number of advantages are realized in the swim fin 10 because of the configuration of the harness 12. Initially, the design on the harness 12 assures that the swim fin 10 will fit a wide variety of foot sizes. The liner strap 48 acts as the tongue in a shoe to protect the wearer's foot from forces in the harness, particularly the strap portions 20 and 22.

The harness 12 is particularly comfortable with the wearer's toes having freedom of movement. The harness 12 crosses the instep of the foot so that foot muscles need not be exerted during swimming strokes with the fins. Only the leg muscles need be used so that the present swim fin tends to eliminate or minimize cramping in the feet.

Figure 4A:
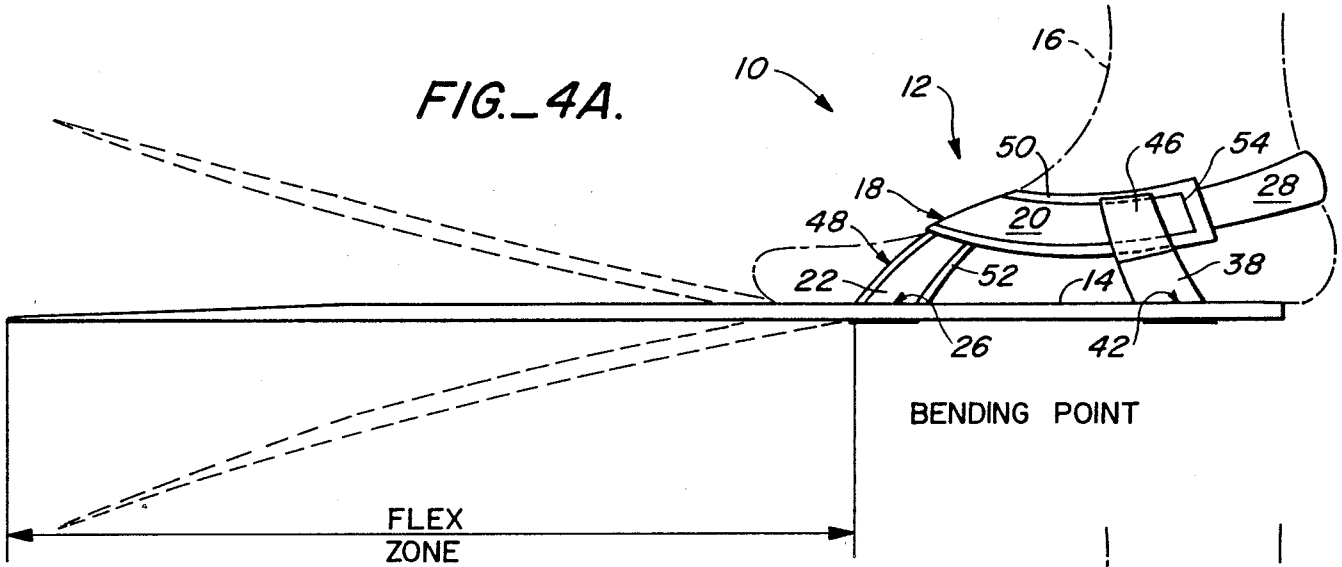
FIG. 4A is a view similar to FIG. 1 while representing increased bending or flexure possible in the swim fin of the present invention.

The flat configuration of the fin as best illustrated in FIGS. 2 and 4A makes the swim fin 10 particularly light weight and very compact so that the swim fin is easy to pack or store, for example.

Figure 4B:
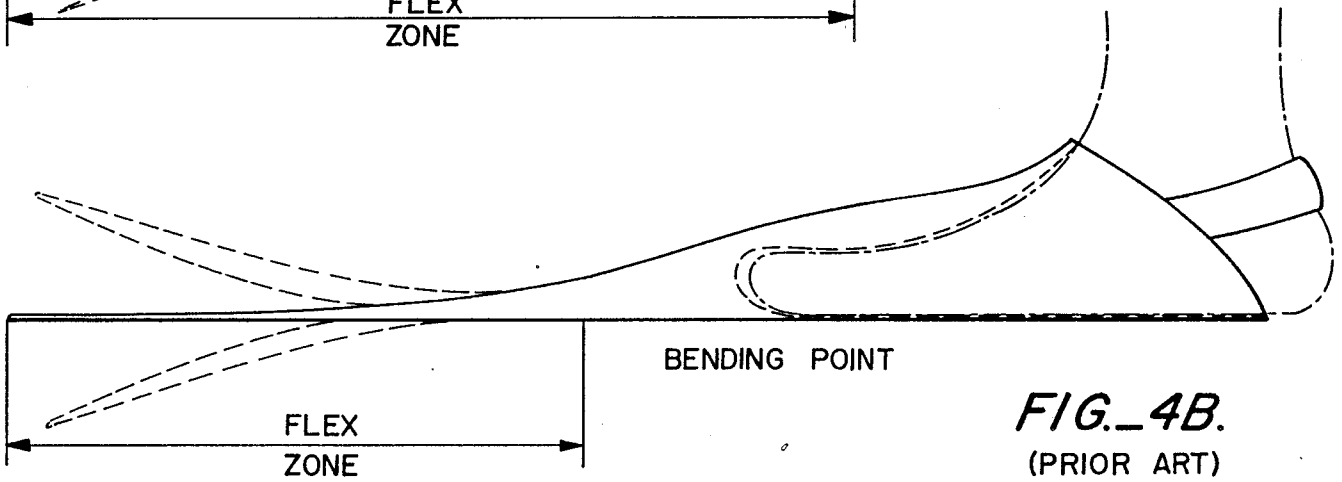
FIG. 4B. (PRIOR ART)
FIG. 4B is a view similar to FIG. 4A but of a swim fin constructed according to the prior art to better illustrate the improvements of the present invention as illustrated in FIG. 4A to the prior art.

In addition, the relatively flat configuration of the fin 10 permits it to bend from a mid-foot portion generally beneath the wearer's instep. Such bending cannot be accomplished in prior art designs illustrated in FIG. 4B where a pocket is formed for receiving the wearer's foot. In those designs, the cross-section of the pocket generally permits only a forward portion of the fin to bend or flex as diagrammatically indicated in FIG. 4B. Accordingly, the swim fin of the present invention is more suitable for enhancing swimming and permits a swimmer to achieve greater speed for a given unit length of the fin.

As illustrated in FIGS. 1–3, the swim fin 10 is preferably formed with longitudinal flanges extending beneath the wearer's foot and along a forwardly extending portion of the fin. Those flanges are illustrated respectively at 58, 60 and 62. The central flange 58 extends generally forwardly from the region between the slots 32 and 34. This permits a lateral indentation (not shown) to be formed beneath the fin 10 for receiving the single strap 18 and the liner strap 48 where they pass beneath the fin between the slots. The flanges 60 and 62 extend from a mid-foot location along the forward edges of the fin while extending both upwardly and downwardly from the fin surfaces. As noted above, the length and cross-sections of the flanges 58, 60 and 62 may be varied to control the amount of bending or flexing experienced by the swim fin during swimming motion. Thus, the flanges may be configured to, in effect, "tune" the swim fin 10 for accomplishing their purpose.

In any event, the harness 12 of the present invention is of particularly simple construction while also facilitating use by a wearer. The wearer may simply insert the instep or forward portion of his foot beneath the strap portions 20 and 22 while securing the strap around his foot by means of the adjustable buckle 30 in order to assure a comfortable fit for the swim fin 10.

It is of course contemplated that mirror image configurations may be formed in both the swim fin 10 and the harness 12, if necessary, to better adapt to the wearer's left and right feet. Similarly, the adjustable strap 18 is preferably formed from flexible material in order to better conform to the configuration of the wearer's foot and to comfortably secure the swim fin in place. A comfortable fit for the swim fin is even further assured by the liner strap 48 discussed above.

There has thus been described a swim fin with harness suitable for securing the swim fin on a wearer's foot. Other variations will be apparent in addition to those specifically described above. For example, although certain features of the swim fin of the present invention are similar to features of the swim fin illustrated in the parent noted above, other features of the swim fin in the parent may suggest modifications in the present swim fin. Accordingly, the scope of the present invention is defined only by the following appended claims.

What is claimed is:

1. A swim fin including a harness for securing the fin beneath a wearer's foot, the harness comprising a strap passing behind the wearer's heel, along both sides of the foot and over an instep portion of the wearer's foot in an X configuration, to respective anchor points arranged on the swim fin on opposite sides of a forward portion of the wearer's foot, means for adjusting the length of the strap to conform to the wearer's foot and to secure the swim fin in place, the adjustable strap being formed by a single strap passing through slots at the forward anchor points and under the fin between the forward anchor points.

2. The swim fin of claim 1 further comprising lateral strap portion anchored at points on opposite sides of a rearward portion of the wearer's foot and secured to opposite side portions of the adjustable strap by respective slide means.

3. The swim fin of claim 2 wherein the swim fin is formed with a generally flat configuration beneath the wearer's foot and an outwardly tapered portion extending forwardly of the wearer's foot whereby the fin is capable of bending or flexing beneath the wearer's foot rather than only forward of the wearer's foot to further facilitate effectiveness of the swim fin.

4. The swim fin of claim 3 further comprising flange means formed longitudinally upon the swim fin beneath and along the length of the wearer's foot and extending forwardly of the wearer's foot for controlling the amount of bending or flexing experienced in the fin.

5. The swim fin of claim 2 further comprising liner straps arranged in slideable relation on respective portions of the strap passing over the instep portion of the wearer's foot to facilitate adjustment of the length of the adjustable strap and to protect the wearer's foot from irritation by the adjustable strap.

6. The swim fin of claim 5 wherein the liner straps are formed with slots adjacent the slide means for receiving opposite side portions of the adjustable strap.

7. The swim fin of claim 6 wherein the adjustable strap is formed by a single strap passing through slots at the forward anchor points and under the fin between the forward anchor points, the liner straps also being formed by a single strap similarly passing through the forward slots and under the fin between the forward anchor points.

8. The swim fin of claim 6 wherein the liner straps are formed with multiple slots adjacent the respective slide means to further enhance adjustability of the adjustable strap.

9. The swim fin of claim 2 wherein the adjustable strap is formed by a single strap passing through slots at the forward anchor points and under the fin between the forward anchor points.

10. A swim fin assembly, comprising a swim fin formed with a generally flat configuration beneath the wearer's foot and an outwardly tapered portion extending forwardly of the wearer's foot whereby the fin is capable of bending or flexing beneath the wearer's foot rather than only forward of the wearer's foot to further facilitate effectiveness of the swim fin, strap means secured to forward and rearward anchor points for passing over and around the wearer's foot to secure the swim fin thereto without impeding movement of the wearer's toes, and means for adjusting length of the strap means to conform to the size of the wearer's foot and to secure the swim fin in place, and liner straps arranged in slideable relation on respective portions of the strap passing over the instep portion of the wearer's foot to facilitate adjustment of the strap length and to protect the wearer's foot from irritation by the adjustable strap.

11. The swim fin of claim 10 further comprising flange means formed longitudinally upon the swim fin beneath and along the length of the wearer's foot and extending forwardly of the wearer's foot for controlling the amount of bending or flexing experienced in the fin.

* * * * *